US007229056B2

(12) United States Patent
Rosser et al.

(10) Patent No.: US 7,229,056 B2
(45) Date of Patent: Jun. 12, 2007

(54) SUPPORT SYSTEM

(75) Inventors: Trudy Bittner Rosser, Dalkeith (AU); John G. Rosser, Dalkeith (AU)

(73) Assignee: Serros Pty Ltd., Dalkeith, WA (AU)

( * ) Notice: Subject to any disclaimer, the term of this patent is extended or adjusted under 35 U.S.C. 154(b) by 220 days.

(21) Appl. No.: 10/820,676

(22) Filed: Apr. 7, 2004

(65) Prior Publication Data

US 2005/0193625 A1 Sep. 8, 2005

(30) Foreign Application Priority Data

Feb. 18, 2004 (AU) ..... 200400837

(51) Int. Cl.
*A47K 1/08* (2006.01)

(52) U.S. Cl. ..... 248/311.2; 248/309.1; 47/67; 47/68

(58) Field of Classification Search ..... 248/309.1, 248/311.2, 316.1; 47/68, 67
See application file for complete search history.

(56) References Cited

U.S. PATENT DOCUMENTS

| | | | | |
|---|---|---|---|---|
| 3,477,679 | A * | 11/1969 | Lovitz | 248/213.2 |
| 3,765,632 | A * | 10/1973 | Riggs | 248/231.71 |
| 4,739,582 | A * | 4/1988 | Cullinane | 47/41.12 |
| 4,984,722 | A * | 1/1991 | Moore | 224/549 |
| 5,779,206 | A * | 7/1998 | Harris et al. | 248/214 |
| 5,873,555 | A * | 2/1999 | Crace | 248/312.1 |

FOREIGN PATENT DOCUMENTS

| | | | |
|---|---|---|---|
| DE | 200 14 817 | | 2/2002 |
| EP | 0 334 770 | * | 2/1989 |
| FR | 81 15237 | | 2/1983 |
| JP | 2001017791 | | 1/2001 |
| JP | 2003111997 | | 4/2003 |

OTHER PUBLICATIONS

Elho, Easy Supports, Balcony Hooks, Belin, Porto Easy Balcony, and Vienna QuickFix Balcony models, http://www.elho.nl/dynpp/index.php, accessed Nov. 2, 2004. 15 pages of digital photos.
Georg Hagens, Balcony and Terrace planters, http://www.haus-garten-hobby.de/balkonkasten.htm, accessed Nov. 2, 2004. 1 page of digital photos.

* cited by examiner

*Primary Examiner*—Amy J. Sterling
(74) *Attorney, Agent, or Firm*—Sheridan Ross P.C.

(57) ABSTRACT

A window box 10 comprises a receptacle 12 provided with an integrally formed pair of upper sleeves 14, and an integrally formed pair of lower sleeves 36. Arms 16 are adjustably engaged within respective sleeves 14 so that distal ends 20 of each arm 16 can be positioned at one of a plurality of distances from the receptacle 12. The distal end 20 of each arm is shaped to hook over a support 22. Arms 38 are adjustably engaged in the sleeves 36 and abut the support 22 to hold the window box 10 in a vertical disposition.

17 Claims, 3 Drawing Sheets

SUPPORT SYSTEM

FIELD OF THE INVENTION

The present invention relates to a support system.

BACKGROUND OF THE INVENTION

Window boxes are in common use throughout the world for people living in apartments. The window box provides an occupant of an apartment with the opportunity to grow plants particularly flowers or vegetables in a box which is supported outside of the apartment on a windowsill or balustrade. The expression "window box" throughout this specification is intended to denote a box or receptacle which can be supported on any structure such as a wall, windowsill, balustrade or rail.

The typical window box is in the form or a rectangular box made from a variety of materials such as plastics materials, corrosion resistant metals and alloys, and earthenware. Various methods have been employed for attaching the window box to a structure. This includes use of mechanical fasteners such as screws and bolts, and brackets which are fastened to both the window box and the structure to which the window box is to be attached.

The present invention has its genesis in the consideration of alternate ways for fixing of a window box to a window. However embodiments of the resulting invention are not limited to use for a window box, but can be applied to other devices and apparatus, such as but not limited to, tables and clothes lines.

SUMMARY OF THE INVENTION

According to the present invention there is provided a support system comprising:

a structure for bearing a load;

at least one first engagement mechanism integrally formed with said structure; and, a first arm for each of said first engagement mechanisms, each first arm having a proximal end engaged in a respective first engagement mechanism and an opposite distal end shaped to hook over a support whereby said structure is supported on said support by hooking said distal end of said arm over said support.

Preferably each of said first arms is adjustably engaged by a respective one of said first engagement mechanisms whereby said distal end of said first arm can be positioned at one of a plurality of distances from said structure.

Preferably said support system further comprises a first releasable locking mechanism which releasably locks said distal end of said first arm at one of a plurality of said distances from said structure.

Preferably said releasable locking mechanism comprises a plurality of ratchet teeth formed on one of said first arm and said first engagement mechanism, and a pawl formed on the other of said first arm and said first engagement mechanism, said pawl biased into engagement with said teeth.

Preferably said support system further comprises at least one second engagement mechanism integrally formed with said structure; and, a second arm for each of said second engagement mechanisms, each second arm having a proximal end engaged in a respective second engagement mechanism and an opposite distal end configured to abut said support.

Preferably said distal end of said second arms is disposed below a position where said first arm hooks over said support.

Preferably each second arm is adjustably engaged by a respective second engagement mechanism whereby said distal end of each second arm can be positioned at one of a plurality of distances from said structure.

Preferably said support system further comprises a second releasable locking mechanism which releasably locks said distal end of each of said second arms at one of said plurality of distances from said structure.

In one embodiment said structure comprises a receptacle.

Preferably said receptacle comprises a base and a peripheral structure extending from said base and having an upper end defining an opening into which said articles can be placed into said receptacle; said first engagement structures formed integrally at said upper end of the peripheral wall, and said second engagement structures formed integrally with said receptacle adjacent said base.

In an alternate embodiment said structure comprises a planar surface.

In a further alternate embodiment said structure comprises a substantially planar frame. In this embodiment said planar frame further comprises one or more cords or lines extending between opposite sides of said frame.

Preferably said structure comprises two of said first engagement mechanisms and two of said second engagement mechanisms.

Throughout this specification, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

BRIEF DESCRIPTION OF THE DRAWINGS

An embodiment of the present invention, taking the form of a window box, will now be described by way of example only with reference to the accompanying drawings in which.

DETAILED DESCRIPTION OF PREFERRED EMBODIMENT

Figure 1:
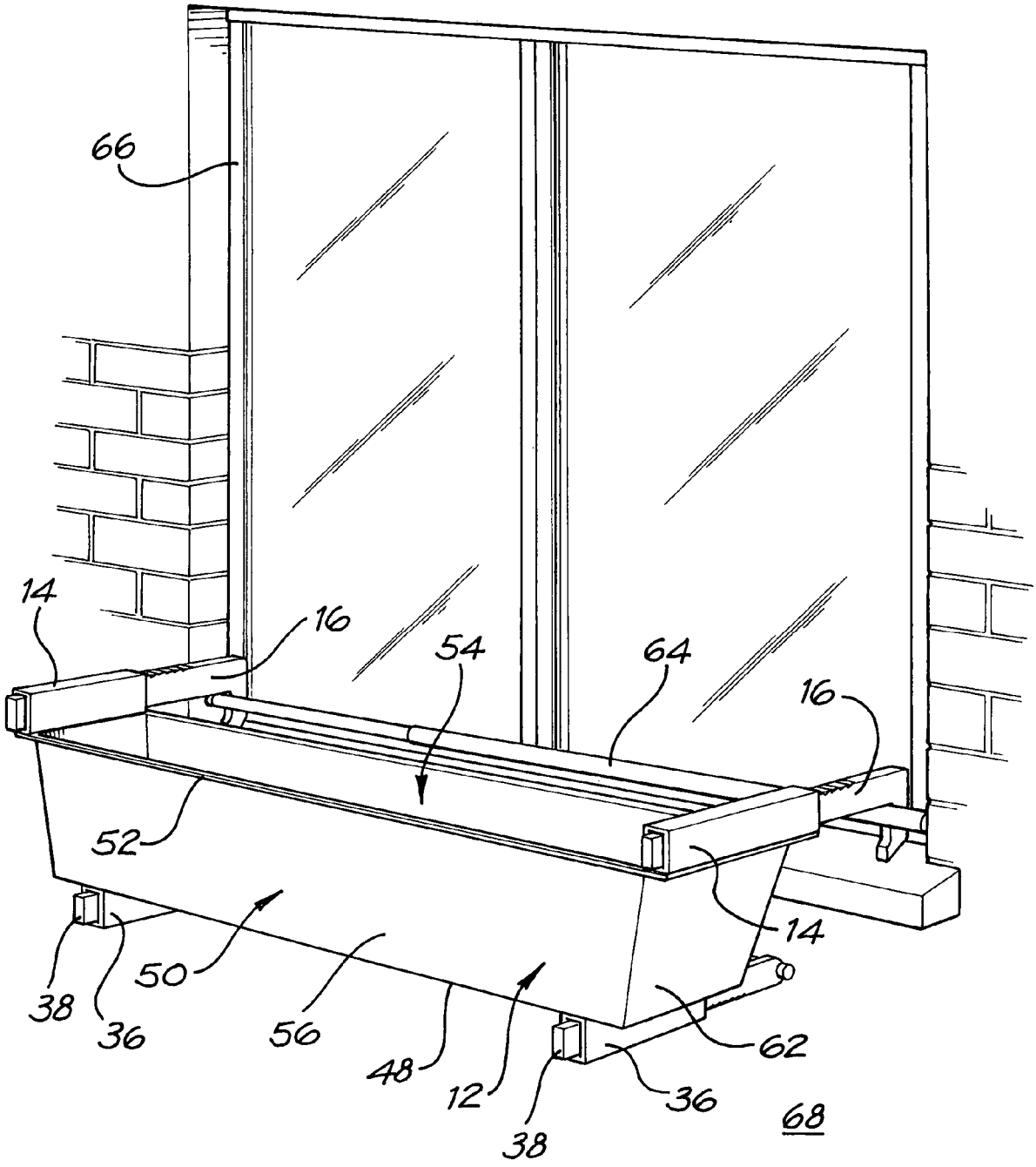
FIG. 1 is a schematic representation of a window box in accordance with the present invention.
Figure 2:
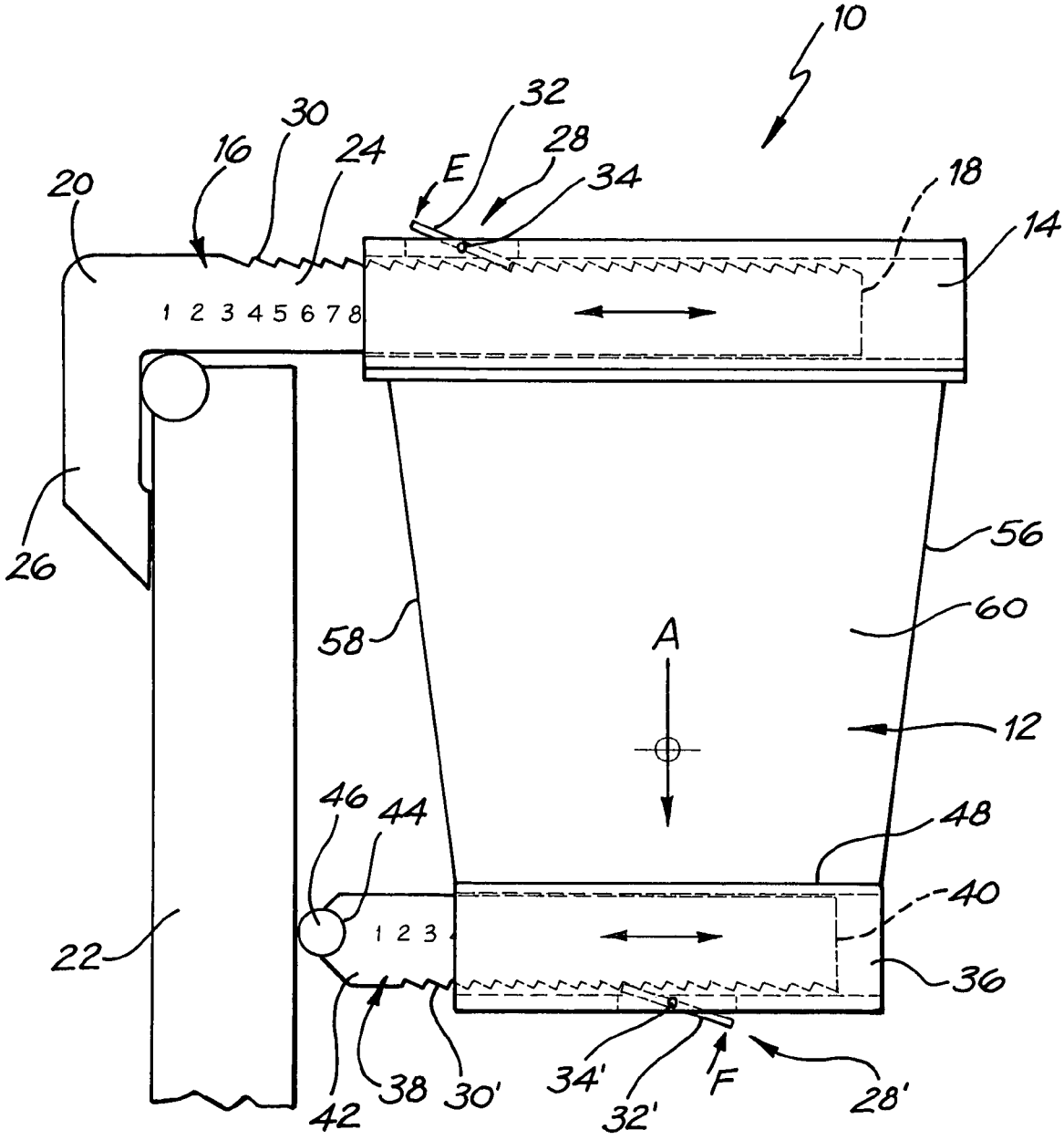
FIG. 2 is a schematic representation of a side view of the window box.

Referring to the accompanying drawings and in particular, FIGS. 1 and 2, a support system in the form of a window box 10 in accordance with the present invention comprises a structure, taking the form of a receptacle 12, for holding one or more articles, such as pot plants (not shown); at least one (in this instance two) first engagement mechanisms in the form of rectangular sleeves 14 integrally formed with the receptacle 12; and, a first arm 16 for each of the sleeves 14. Each arm 16 has a proximal end 18 engaged in a respective sleeve 14 and an opposite distal end 20 shaped to hook over a support 22 whereby the window box 10 is supported on the support 22 by hooking the distal end 20 of the arm 16 over the support 22.

Each of the arms 16 is in the shape of an uppercase letter L comprising a relatively long portion 24 and a relatively short portion 26. The proximal end 18 is formed at the end of the long portion 24 distant to the short portion 26. The distal end 20 comprises the short portion 26 together with an adjacent part of the long portion 24 to define a hook like structure for hooking over the support 22.

The arms 16 are adjustably engaged by respective sleeves 14 so that the distal end 20 of each arm 16 can be positioned at one of a plurality of distances from the receptacle 12. Moreover, the window box comprises a releasable locking mechanism 28 for releasably locking the distal end 20 of each arm 16 at one of the aforementioned plurality of distances from the receptacle 12.

The releasable locking mechanism in this embodiment is in the form of a pawl and ratchet structure where ratchet teeth 30 are formed along an edge of long portion 24 of the arm 16 on a side distance the short portion 26; and, a pawl 32 is coupled with each sleeve 14. The pawl 32 is in the form of a finger or plate which is coupled by a pivot pin 34 within a corresponding sleeve 14 and is biased, either by gravity or by a bias mechanism such as a spring, into engagement with the teeth 30 and the edge of the arm 16 containing the teeth 30. The teeth 30 and pawl 32 are arranged so that when mutually engaged, they prevent distal end 20 from being pulled away from the receptacle 12. In order to pull the distal end 20 away from the receptacle 12, the pawl 32 must be disengaged from the teeth 30, by pivoting about pin 34 against its bias.

The window box 10 further comprises second engagement mechanisms also in the form of sleeves 36 and corresponding second arms 38 for each of the sleeves 36. Each arm 38 has a proximal end 40 which is engaged in a sleeve 36 and a distal end 42 for abutting the support structure 22. The arms 38 are straight although the distal end 42 may be provided with a cutout 44 for seating a transverse stabilising bar 46. Whether or not the cutout 44 and stabilising bar 46 are required is dependant on the form of the structure 22 on which the window box 10 is to be supported. This will be discussed in greater detail below.

A releasable locking mechanism 28' identical to that used in relation to the first arm 16 is incorporated for releasably locking the distal end 42 of each arm 38 at one of a plurality of distances from the receptacle 12. The mechanism 28' comprises a series of teeth 30' formed along one edge of the arm 38 together with a pawl 32' pivotally coupled by pin 34' to the sleeve 36 and biased so as to engage the teeth 32' and the edge of the arm 38 provided with the teeth 301. The pawl 28' is biased, for example by gravity or a bias mechanism such as a spring, to ordinarily engage the teeth 30' to prevent the distal end 42 from being pushed in toward the receptacle 12 while engaged.

As seen most clearly from FIG. 1, the receptacle 12 comprises a base 48 and a peripheral wall 50 extending upwardly from the base 48 and having an upper end 52 defining an opening 54 into which articles, eg. pot plants, can be placed into the receptacle 12 to be supported on the base. The peripheral wall 50 is constituted by parallel front and back walls 56 and 58 and parallel side walls 60 and 62 which extend between the front and back walls 56 and 58. The sleeves 14 for the arms 16 are formed integrally with the receptacle 12 and the upper end 52 while the sleeves 36 are formed integrally with the base 48. The sleeves 36 are disposed below the sleeves 14 and in this embodiment are in-board of the sleeves 14.

In use, the arms 16 are extended as necessary by disengagement of the pawl 32 and teeth 30 to hook over the support 22 thereby engaging the box 10 with the support 22. The arms 38 are extended from their respective sleeves 36 by disengagement of the pawl 32' with the teeth 30' to a position to hold the receptacle 12 in a substantially vertical plane. It will be appreciated that the window box 10 can be attached to a support 22 such as a window sill without the need for mechanical fasteners and tools such as screwdrivers, drills, hammers etc. Further, the structure of the arms 16 and 38 and their respective sleeves 14 and 36 allows easy adjustment of the box 10 for engagement with supports of different shape and configuration while maintaining the box 10 in a vertical disposition. Ideally, the box 10 inclusive of the arms 16 and 38 will be made from plastics material with the receptacle 12 and the sleeves 14 and 36 being integrally formed.

Figure 5:
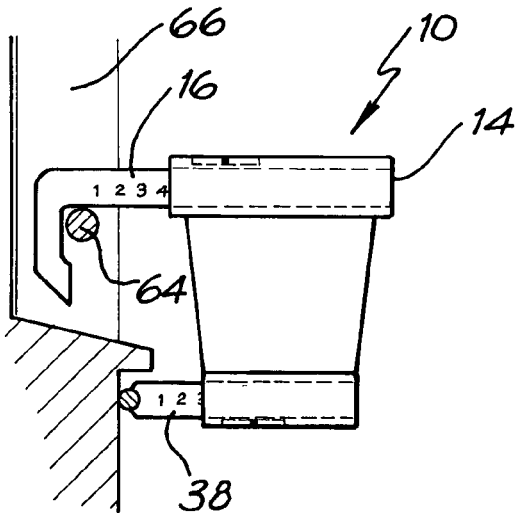
FIG. 5 is a side view of the window box shown in FIG. 1.

In FIGS. 1 and 5, the box 10 is supported by a restrainer or support bar 64 which extends within a window frame 66. A specific restraining or support bar which may be used in connection with the window box 10 is described in Applicants co-pending Australian Provisional Application number 200400837, the contents of which is incorporated herein by way of reference. Also in the embodiment in FIG. 1, the arms 38 formed with a square distal end 42 for abutment against a wall 68 in which the window frame 66 is formed.

Figure 3:
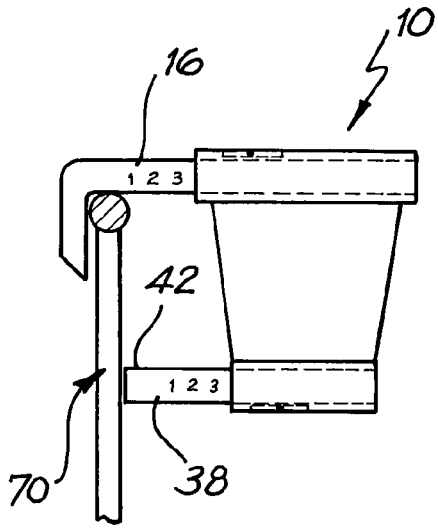
FIGS. 3 and 4 depict a window box coupled to different forms of support structures.

In FIG. 3, the window box 10 is depicted being coupled to a fence 70. Here the distal end 42 of arm 38 is also formed square and abuts directly against the fence 70.

Figure 4:
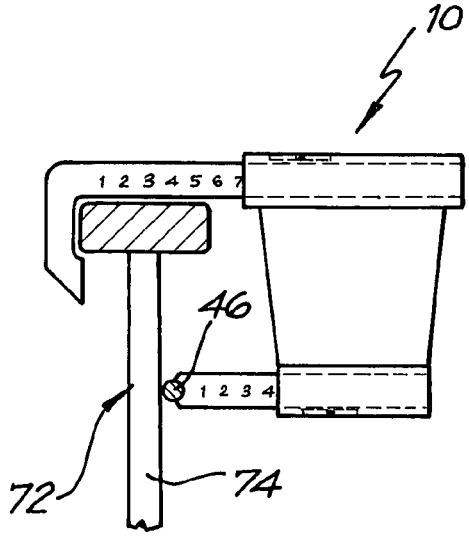

In FIG. 4, the window box 10 is shown supported on a balustrade or vertical bar fence 72 which comprises a plurality of spaced apart vertically extending rails 74. In this embodiment, the distal end 42 of the arm 38 is in the form depicted in FIG. 2 and incorporates the cutout 44 receiving the bar or tie rod 46 which abuts against the rails 74. Opposite ends of the bar or tie rod 46 are received in the cutouts 44 of each of the arms 38.

Figure 6:
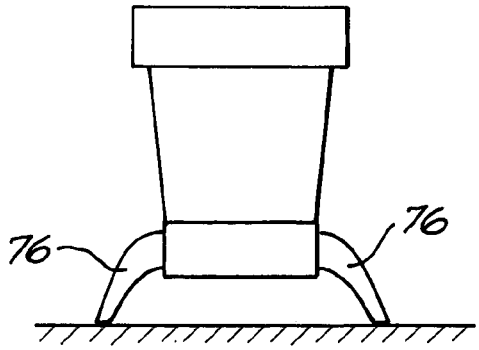
FIG. 6 depicts a freestanding window box.

FIG. 6 depicts the receptacle 12 being freestanding with support legs 76 being received in the sleeves 36 so that the receptacle 12 may be used as a conventional planter box.

Now that embodiments of the present invention have been described in detail it will be apparent to those skilled in the relevant arts that numerous modifications and variations may be made without departing from the basic inventive concepts. For example, the window box 10 is depicted as being provided with two spaced apart sleeves 14 and corresponding arms 16. However, embodiments are envisaged comprising only a single sleeve 14 and arm 16 located centrally of the receptacle 12. Alternately, three or more sleeves 14 and corresponding arms 16 may be incorporated. Further, the window box 10 may be provided with a single centrally located sleeve 36 and corresponding arm 38. In addition, the releasable locking mechanism 28 need not be in the form of ratchet teeth 30, 30' and a pawl 32, 32'. Other types of releasable locking mechanisms such as pins and holes may be incorporated. Further, while the support system is described as comprising a window box, with the structure itself in the form of a box per se, it may take many other forms. In particular the structure can take the form of or comprise a planar surface to provide a table; or a planar frame with one or more cords or lines extending from side to side to provide a clothes line.

All such modifications and variations together with others that would be obvious to a person of ordinary skill in the art are deemed to be within the scope of the present invention the nature of which is to be determined from the above description.

The claims defining the invention are as follows:

1. A support system, comprising:

a receptacle having a base and a peripheral wall extending from said base and having an upper end defining an opening that is adapted to receive one or more articles;

a sleeve integrally formed with said receptacle;

a first arm inserted through said sleeve said first arm having a proximal end remaining in said sleeve and a distal end extending beyond said sleeve and extending away from said receptacle in a first direction;

a second sleeve integrally formed with said receptacle;

a second arm inserted through said second sleeve said second arm having a proximal end remaining in said sleeve and a distal end extending beyond said sleeve and wherein said distal end of said second arm is disposed below said first arm and extends in said first direction; and a stabilizing bar coupled to said second arm and extending laterally to about the support.

2. The support system according to claim 1 wherein said first arm is adjustably engaged by said first engagement mechanisms whereby said distal end of said first arm can be positioned at one of a plurality of distances from said receptacle.

3. The support system according to claim 2 further comprising a first releasable locking mechanism positioned within said at least one first engagement mechanism which releasably locks said distal end of said first arm at one of a plurality of said distances from said receptacle.

4. The support system according to claim 3 wherein said releasable locking mechanism comprises a plurality of ratchet teeth formed on one of said at least one first arm and said first engagement mechanism, and a pawl formed on the other of said first arm and said at least one first engagement mechanism, said pawl biased into engagement with said teeth.

5. The support system according to claim 2 wherein said second arm is adjustably engaged to said by a respective second engagement mechanism whereby said distal end of each second arm can be positioned at one of a plurality of distances from said receptacle.

6. The support system according to claim 5 further comprising a second releasable locking mechanism positioned within said at least one second engagement mechanism which releasably locks said distal end of each second arm at one of said plurality of distances from said receptacle.

7. The support system according to claim 1 wherein said at least one first engagement mechanism is formed integrally at said upper end of the peripheral wall, and said at least one second engagement mechanism is formed integrally with said receptacle adjacent said base.

8. The support system according to claim 1 comprising at least two said second engagement mechanisms and a corresponding plurality of said second arms and, wherein said rod is coupled to and extends between two or more of said second arms.

9. The support system according to claim 1 further comprising a scale marked on said first arm and said second arm, and providing an indication of distance from the distal ends of said first and second arms from said receptacle.

10. A window box comprising:

a box portion having a base and a peripheral wall extending from said base and having an upper end defining an opening that is adapted to receive one or more articles into said box portion;

at least one first engagement mechanism integrally formed with said box portion at an upper end of the peripheral wall;

a first arm for receipt into said at least one first engagement mechanism, said first arm having a proximal end engaged in said at least one first engagement mechanism and a distal end that is adapted to hook over a support;

at least one second engagement mechanism integrally formed with said box portion adjacent said base;

a second arm for receipt into said at least one second engagement mechanisms, said second arm having a proximal end engaged in said at least one second engagement mechanism and a distal end adapted to abut the support, wherein said distal end of said second arms is disposed below a position where said first arm hooks over the support;

a stabilizing bar coupled to said second arm and extending laterally to abut the support; and at least one first engagement mechanism is formed integrally at said upper end of the peripheral wall, and said at least one second engagement mechanism is formed integrally with said box portion adjacent said base.

11. The window box according to claim 10 wherein said first arm is adjustably engaged to said at least one first engagement mechanism whereby said distal end of each said first arm can be positioned at one of a plurality of distances from said box portion.

12. The window box according to claim 11 further comprising a first releasable locking mechanism for engagement to said first arm which releasably locks the distal end of said first arm at any of said one of a plurality of said distances from said box portion.

13. The window box according to claim 12 wherein said releasable locking mechanism comprises a plurality of ratchet teeth formed on one of said first arm and said at least one first engagement mechanism, and a pawl formed on the other of said first arm and said at least one first engagement mechanism, said pawl biased into engagement with said teeth.

14. The window box according to claim 10 wherein said second arm is adjustably engaged to said at least one second engagement mechanism whereby said distal end of said second arm can be positioned at one of a plurality of distances from said box portion.

15. The window box according to claim 14 further comprising a second releasable locking mechanism for said second arm which releasably locks said distal end of said second arm at any of said one of a plurality of distances from said box portion.

16. The window box according to claim 10 comprising at least two of said second engagement mechanisms and a corresponding number of said second arms; and, wherein the rod is coupled to and extends between two or more of said second arms.

17. The window box according to claim 10 further comprising a scale marked on one or both of said first arms and said second arms that provide an indication of distance from the distal ends of said first and second arms from said box portion.

* * * * *

UNITED STATES PATENT AND TRADEMARK OFFICE

CERTIFICATE OF CORRECTION

PATENT NO. : 7,229,056 B2
APPLICATION NO. : 10/820676
DATED : June 12, 2007
INVENTOR(S) : Trudy Bittner Rosser and John G. Rosser It is certified that error appears in the above-identified patent and that said Letters Patent is hereby corrected as shown below:

Column 5, Line 19, please delete the word "about" and insert the word -- abut --.

Signed and Sealed this

Twenty-first Day of October, 2008

JON W. DUDAS
*Director of the United States Patent and Trademark Office*